US012773049B2

(12) United States Patent
Chen et al.

(10) Patent No.: US 12,773,049 B2
(45) Date of Patent: Oct. 27, 2026

(54) SPRING MECHANISM FOR ROCKER ASSEMBLY AND ROCKER ASSEMBLY COMPRISING THE SAME

(71) Applicant: Leggett & Platt (Jiaxing) Co., Ltd., Jiaxing (CN)

(72) Inventors: Jun Chen, Jiaxing (CN); Zongfeng Guo, Jiaxing (CN); Ziliu Pan, Jiaxing (CN); Guoming Shen, Jiaxing (CN); Lei Mao, Jiaxing (CN); Xiaoli Chen, Jiaxing (CN); Jiahao Wu, Jiaxing (CN); Patrick Third, Ooltewah, TN (US); Jason Stokesbary, Georgetown, KY (US); Jason Carr, Thaxton, MS (US)

(73) Assignee: L&P Property Management Company, Carthage, MO (US)

( * ) Notice: Subject to any disclaimer, the term of this patent is extended or adjusted under 35 U.S.C. 154(b) by 82 days.

(21) Appl. No.: 18/678,125

(22) Filed: May 30, 2024

(65) Prior Publication Data

US 2024/0315454 A1 Sep. 26, 2024

Related U.S. Application Data

(63) Continuation-in-part of application No. 18/086,829, filed on Dec. 22, 2022.

(30) Foreign Application Priority Data

Dec. 23, 2021 (CN) ..... 202111609043.6

(51) Int. Cl.

| | |
|---|---|
| ***A47C 3/025*** | (2006.01) |
| *A47C 3/027* | (2006.01) |
| *A47C 3/18* | (2006.01) |

(52) U.S. Cl.
CPC ..... *A47C 3/0255* (2013.01); *A47C 3/027* (2013.01); *A47C 3/18* (2013.01)

(58) Field of Classification Search
CPC ..... A47C 3/0255; A47C 3/027; A47C 3/0355; A47C 3/0252; A47C 3/18
See application file for complete search history.

(56) References Cited

U.S. PATENT DOCUMENTS 2,772,723 A 12/1956 Tunnell
3,547,393 A * 12/1970 Gordin ..... A47C 3/0252 297/263.2

(Continued)

FOREIGN PATENT DOCUMENTS

| | | | |
|---|---|---|---|
| CA | 2974705 | C | 2/2021 |
| CN | 101287393 | A | 10/2008 |
| CN | 103786651 | A | 5/2014 |

OTHER PUBLICATIONS

Non-Final Office Action received for U.S. Appl. No. 18/086,829, mailed on Feb. 12, 2026, 7 pages.

(Continued)

*Primary Examiner* — Syed A Islam
(74) *Attorney, Agent, or Firm* — Shook, Hardy & Bacon

(57) ABSTRACT

A rocker box for use on a rocker chair is provided. The rocker box includes a base plate; a rocker plate spaced from the base plate and pivotally coupled to the base plate at a pivot axis; a pair of springs extending between the base plate and the rocker plate, the springs being coupled on one end to the base plate and on the other end to the rocker plate; and a spacer extending between the springs and each of the base plate and the rocker plate, such that the first springs do not directly contact the surface of the base plate or the rocker plate.

15 Claims, 7 Drawing Sheets

(56) References Cited

U.S. PATENT DOCUMENTS

| | | | | |
|---|---|---|---|---|
| 4,401,290 | A | 8/1983 | Butler | |
| 5,171,000 | A | 12/1992 | Lapointe et al. | |
| 5,567,009 | A | 10/1996 | Fay et al. | |
| 6,000,754 | A * | 12/1999 | Lawson ..... | A47C 1/0355 297/DIG. 7 |
| 6,918,632 | B2 | 7/2005 | Maki et al. | |
| 7,275,789 | B2 | 10/2007 | Lapointe | |
| 9,314,101 | B2 | 4/2016 | Harwood et al. | |
| 2017/0240236 | A1 | 8/2017 | Enriquez | |
| 2023/0200537 | A1 | 6/2023 | Chen et al. | |

OTHER PUBLICATIONS

Final Office Action received for U.S. Appl. No. 18/086,829, mailed on Jun. 2, 2026, 8 pages.

* cited by examiner

SPRING MECHANISM FOR ROCKER ASSEMBLY AND ROCKER ASSEMBLY COMPRISING THE SAME

CROSS-REFERENCE TO RELATED APPLICATION

This Nonprovisional Patent Application claims priority to co-pending Chinese Patent Application No. 202111609043.6, which was foreign filed Dec. 23, 2021, and which is titled "Spring Mechanism for Rocker Assembly and Rocker Assembly Comprising the Same," and is a Continuation-in-Part of U.S. patent application Ser. No. 18/086,829, filed on Dec. 22, 2022, and titled "Spring Mechanism for Rocker Assembly and Rocker Assembly Comprising the Same," the contents of which are incorporated herein by reference in their entireties.

TECHNICAL FIELD

The present invention relates to the field of rocking chairs, and more particularly, to a spring mechanism for a rocker assembly in a rocking chair and to a rocker assembly comprising said spring mechanism.

BACKGROUND ART

In daily life, the rocking chair is more and more widely used. To provide greater comfort and flexibility of use for the user, the rocking chair is typically configured to swing, or rock, with a slight force exerted by the user. The user can relax and enjoy the swing of the rocking chair. However, in the rocking chairs of the prior art, loud and harsh frictional noises are often generated during the rocking, which greatly reduces the comfort of the user. In addition, since rocking chairs generate loud noise during the rocking, manufacturers often set a small rocking angle when designing the rocking chair, considering a larger rocking angle will aggravate noise pollution. Consequently, it is difficult to get a satisfactory range of rocking angles of the rocking chair. In other words, the loud noise and the limited rocking angles have reduced the user experience for the product.

BRIEF SUMMARY OF THE INVENTION

The present invention is put forward for providing a rocker assembly that allows a greater rocking angle and a reduced operation noise.

A first aspect of the present invention provides a spring mechanism for a rocker assembly, the spring mechanism being connected to a rocker mechanism of the rocker assembly to assist a rocker/seesaw member of the rocker mechanism in returning from a rocking position to a rest position, wherein the spring mechanism comprises two mounting plates opposed at a spacing and two springs connected between the two mounting plates, each of the mounting plates being provided with two sets of holding structures for holding each of the springs in place on the mounting plate, wherein a spacer is provided between each mounting plate and each spring to avoid the mounting plate from contacting at least one turn of the spring. Advantageously, the spacer takes the form of a plastic washer.

Advantageously, each set of holding structures comprises a clip portion and a locating protrusion formed on the mounting plate, and an end turn of the spring is clipped by the clip portion and positioned by the locating protrusion.

Advantageously, each mounting plate is laterally provided with two lateral openings to allow the end turns of the springs and the spacers to at least partially pass therethrough and be held on the mounting plate by the clip portions and locating protrusions.

Advantageously, the spacer comprises a first portion passing through the lateral opening and positioned by the locating protrusion and the clip portion, and a second portion contiguous to the first portion; and the first and second portions are opposed to each other to form a gap therebetween for receiving an edge of the mounting plate at the lateral opening.

Advantageously, the spacer is provided with a notch for receiving the clip portion and a through hole for receiving the locating protrusion.

A second aspect of the present invention provides a rocker assembly, comprising a base and two rocker mechanisms mounted symmetrically at the left and right sides of the base, wherein the rocker assembly further comprises two spring mechanisms as described above, each of which is connected to the respective rocker mechanism and to the base.

Advantageously, the base comprises two support tubes arranged at a spacing in a horizontal direction and two base plates symmetrically disposed at the left and right sides of the two support tubes, each rocker mechanism being placed on a respective base plate, and each spring mechanism being connected to the respective base plate via a first mounting plate.

Advantageously, each rocker mechanism comprises a rocker member to which a movable member is attached, wherein the movable member is movable as the rocker member swings on the base plate about a fulcrum.

Advantageously, each movable member is connected to a corresponding rocker member via an intermediate bracket, and between two symmetrically arranged intermediate brackets, there are connected two connecting rods which are offset both horizontally and vertically; wherein a second mounting plate of each spring mechanism is fixedly connected to an intermediate connecting plate, which is inserted in a horizontal direction between and respectively connected to the two connecting rods.

Advantageously, a pair of stops is provided symmetrically at the left and right sides of one of the support tubes, intended to abut against the corresponding movable member to limit its further movement.

The spring mechanism of the present invention is provided with a spacer to avoid direct contact between the spring and the mounting plate, which significantly reduces the noise and allows a greater rocking angle. In addition, owing to a compact structure, the rocker assembly in the present invention can be adapted to various types of rocking chairs in structure.

BRIEF DESCRIPTION OF THE SEVERAL VIEWS OF THE DRAWING

The above and other features and advantages of the present invention will become more readily appreciated from the following description of the accompanying drawings, in which.

DETAILED DESCRIPTION OF THE INVENTION

The present invention is described in further detail below with reference to the drawings and the embodiments. Terms such as "first", "second", and the like are used hereinafter to describe elements of the present application, but they are only used to distinguish the elements, and are not intended to limit the nature, sequence, order, or number of the elements. In addition, any reference to orientation such as "up/down", "front/rear" and "left/right" that may be used in the following description refers to the direction or orientation of the rocker assembly in a rocking chair relative to a user seated on the rocking chair. Unless otherwise stated, these orientation terms are only used for convenience of description and are not intended to limit the technical solution of the invention in any way. Furthermore, it should be noted that in the present specification, identical and/or functionally identical technical features are marked by the same or similar reference signs.

Figure 1:
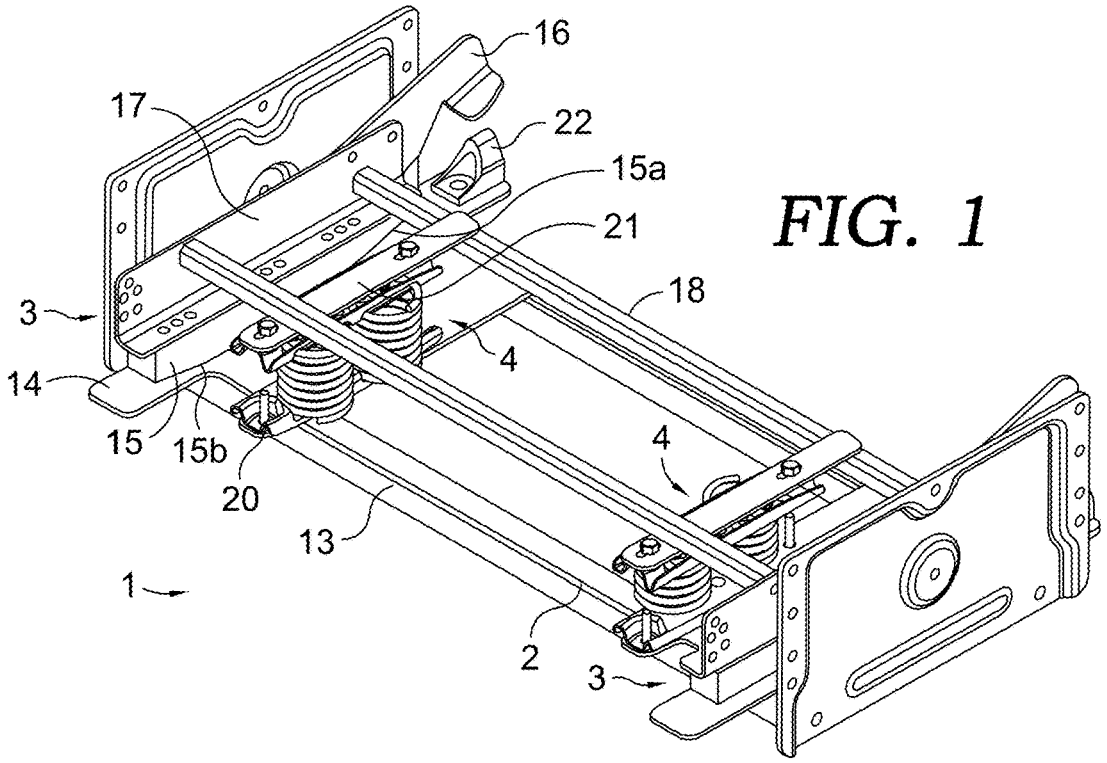
FIG. 1 schematically illustrates a rocker assembly for a rocking chair according to an aspect of this disclosure.

FIG. 1 schematically illustrates a rocker assembly 1 according to an embodiment of the present invention, particularly for use in a rocking chair. The rocker assembly 1 comprises a base 2 and two rocker mechanisms 3 mounted symmetrically at the left and right sides of the base 2. As shown in FIG. 1, the rocker assembly 1 comprises two spring mechanisms 4, each being connected to the respective rocker mechanism 3 and the base 2. Each spring mechanism 4 is connected to a corresponding rocker mechanism 3 (as will be described in more detail below) of the rocker assembly 1 to assist a rocker member of the rocker mechanism 3 in returning from a rocking position to a rest position (i.e., a resting or equilibrium position).

Figure 2:
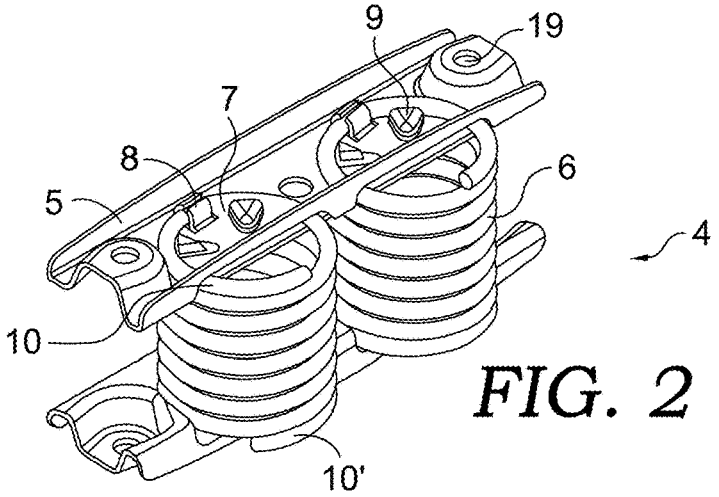
FIG. 2 schematically illustrates the structure of one of the spring mechanisms installed in the rocker assembly.

Referring in particular to FIG. 2, each spring mechanism 4 comprises two mounting plates 5 opposed at a vertical spacing and two springs 6 connected between the two mounting plates 5, each of the mounting plates 5 being provided with two sets of holding structures for holding each of the springs 6 in place on the mounting plate 5, wherein a spacer 7 is provided between each of upper and lower mounting plates 5 and each spring 6. The spacer makes it possible to avoid a direct contact between the spring 6, in particular at least one turn of the spring, and the mounting plate 5 during the rocking process, which greatly reduces the noise generated during the rocking process. To better reduce the noise, the spacer 7 preferably takes the form of a plastic washer. Of course, spacers of other forms or materials that are capable of reducing noise in the art are also possible.

Figure 4:
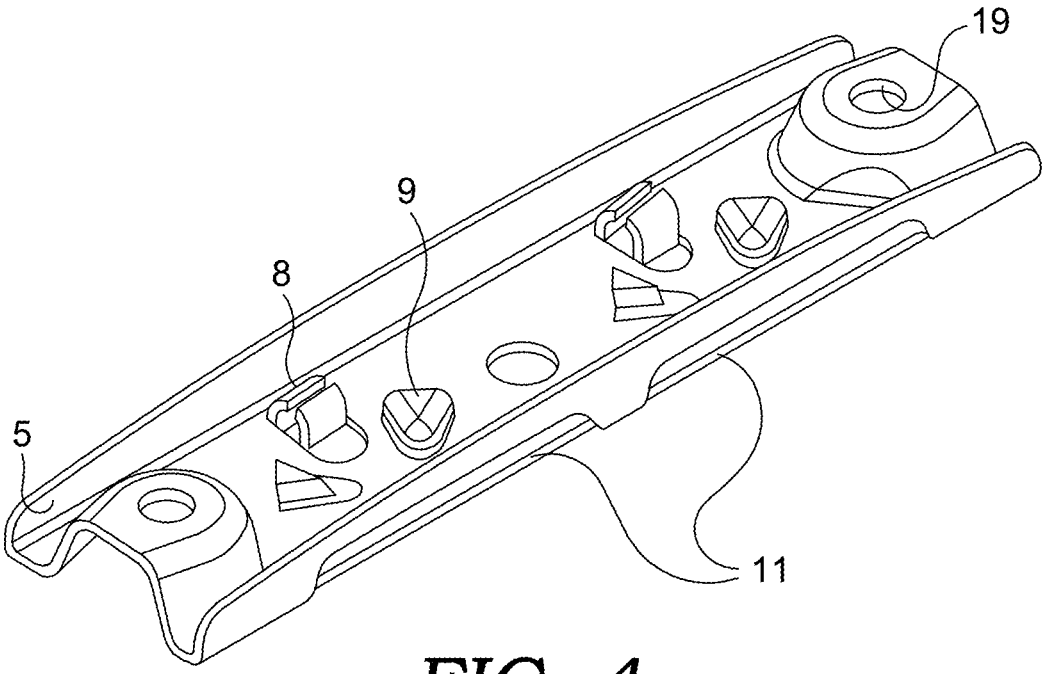
FIG. 4 is a schematic structural view of one of the mounting plates included in the spring mechanism of FIG. 2.

In order to hold the springs 6 and the spacers 7 stably and reliably on the mounting plates 5, each set of holding structures on each mounting plate 5 comprises a clip portion 8 and locating protrusions 9 formed on the mounting plate 5, and the end turns 10, 10' of the spring 6 are clipped by the clip portion 8 and positioned by the locating protrusions 9. According to the schematic structural view for the specific embodiment of the mounting plate 5 shown in FIG. 4, the mounting plate 5 is provided with a clip portion 8 and two locating protrusions 9, wherein the clip portion 8 is formed by deforming a portion of the material of the mounting plate 5. The locating protrusion 9 may be formed integrally with the mounting plate 5. It is to be understood that other forms of clip portions and locating protrusions (e.g., other clipping or locating formations attached to the mounting plate) are also possible, as long as the holding and locating functions intended by the present invention can be achieved.

Referring back to FIGS. 2 and 4, each mounting plate 5 is laterally provided with two lateral openings 11 to allow the end turns of the springs 6 and the spacers 7 to pass at least partially therethrough and be held on the mounting plate 5.

Figure 5:
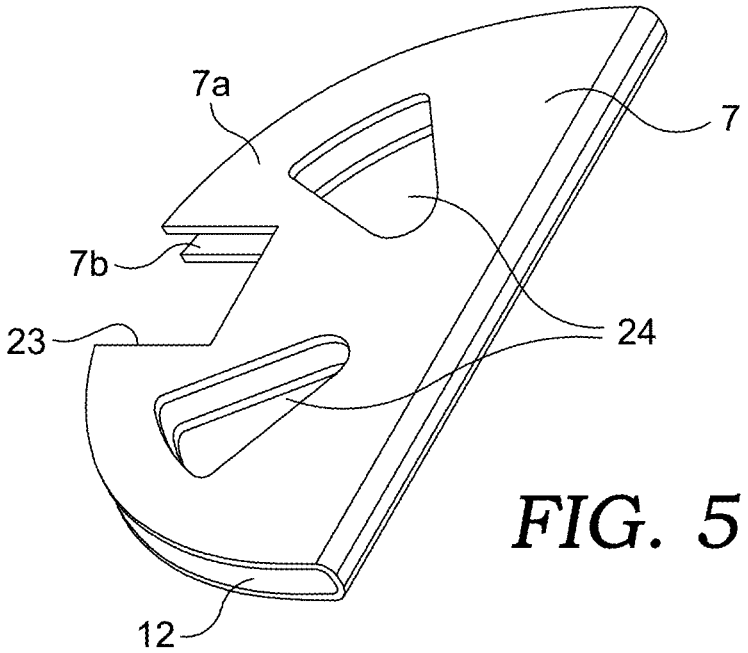
FIG. 5 is a schematic structural view of a spacer arranged between a mounting plate and a spring in a spring mechanism.

Referring particularly to FIG. 5, the spacer 7 comprises a first portion 7*a* and a second portion 7*b* contiguous to and opposite to the first portion 7*a*, so as to form a gap 12 therebetween for receiving the edge of the mounting plate 5 at the lateral opening 11 (see FIG. 2).

Figure 3:
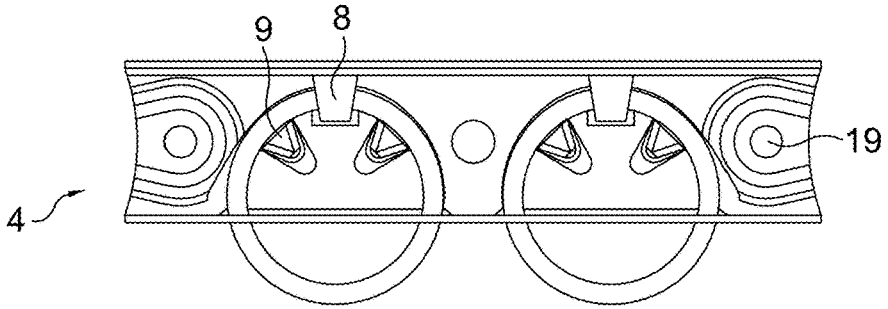
FIG. 3 is a top view of the spring mechanism shown in FIG. 2.

As shown in FIGS. 2 and 3, the first portion 7*a* of the spacer 7 passes through the corresponding lateral opening 11 and engages with the clip portion 8 and the two locating protrusions 9 provided on the mounting plate via the notch 23 and the two through holes 24, respectively, provided on the first portion, and the second portion 7*b* is pressed against another surface of the mounting plate 5 without any clip portion or locating protrusion. In this way, the spacer can be stably and reliably held on the mounting plate.

Preferably, the spacer 7 may be formed by bending a plate sheet, wherein the plate sheet may be provided with the notch 23 and the through hole 24 penetrating through both the first portion and the second portion, formed by folding the plate sheet in half. As such, there is no need to distinguish between the first portion and the second portion when assembling the spacer 7 on the mounting plate 5, while facilitating the processing and saving the cost. Of course, other spacer structures are also possible, as long as the function intended by the present invention can be achieved.

Referring to FIG. 2, after the spacers 7 are mounted on the mounting plates 5, the end turns 10, 10' of the springs 6 can be partially inserted into the mounting plates 5 via the corresponding lateral openings 11, such that a portion of the end turn is clipped by the clip portion 8 on the one hand and positioned by the locating protrusions 9 on the other hand. In this way, the end turn of the spring 6 is spaced from the upper surface of the mounting plate 5 by a first portion of the spacer 7, and the turn adjacent to the end turn is spaced from the lower surface of the mounting plate by a second portion of the spacer 7. As such, two springs are arranged between a pair of mounting plates spaced from each other, and a spacer is provided between each of the upper and lower mounting plates and each spring. The assembled spring mechanism 4 is shown in FIG. 2. Two spring mechanisms 4 are arranged in the rocker assembly 1 as shown in FIG. 1, such that the spring mechanisms 4 are connected to the rocker mechanisms 3 to assist the rocker mechanisms in rocking and returning.

In a specific embodiment of the rocker assembly 1 as shown in FIG. 1, the base 2 comprises two support tubes 13 arranged at a spacing in the horizontal direction and two base plates 14 symmetrically disposed at the left and right sides of the two support tubes 13, each rocker mechanism 3 being placed on a respective base plate 14. Each rocker mechanism 3 comprises a rocker member 15, to which a movable member 16 is attached, wherein the movable member 16 can move as the rocker member 15 swings on the base plate 14 about a fulcrum. The fulcrum may be a point where the bottom surface of rocker member 15 contacts the base plate 14. As can be seen in FIG. 1, the rocker member 15 comprises a pair of inclined surfaces connected via said fulcrum (not specifically shown), wherein a first inclined surface 15*a* (located at the rear end of the rocker) has a greater inclination than a second inclined surface 15*b* (located at the front end of the rocker) to allow a user of the rocking chair to rock within a range of angles using the first inclined surface.

Each movable member 16 is connected to a corresponding rocker member 15 via an intermediate bracket 17, and between two symmetrically arranged intermediate brackets 17, there are connected two connecting rods 18 which are offset both horizontally and vertically. Thus, there is a spacing both in the horizontal direction and in the vertical direction between the two connecting rods.

The mounting plates 5 of each spring mechanism 4 are provided with mounting holes 19 (see FIGS. 2 and 3) for screw elements, wherein the first mounting plate on the base side in FIG. 1 is fixedly connected to the respective base plate 14 via screw elements 20 (such as bolts or the like) passing through the mounting holes, while the second mounting plate on the connecting rod side is fixedly connected to an intermediate connecting plate 21 via the screw elements passing through the mounting holes, wherein the intermediate connecting plate 21 is inserted horizontally into the vertical spacing between the two connecting rods 18, so as to be connected to the two connecting rods 18.

A pair of stops 22 is provided symmetrically on the left and right sides of one (i.e., the support tube 13 located on the rear side of the rocker) of the support tubes 13, intended to abut against the corresponding movable member 16 to limit its further movement.

When a user applies a slight backward force to the rocking chair, the force will be transmitted through a series of links to the intermediate bracket 17 and then to the rocker member 15. The rocker member 15 will rock rearwardly about the fulcrum under the action of the force until the movable member 16 contacts the stop 22.

It will be appreciated that the spring 6 in the spring mechanism 4 connected with the rocker mechanism 3 is in a compressed state in the rest position. When the rocker member 15 swings backwards, the rear spring in the spring mechanism will continue to be compressed via one of the connecting rods 18 and the front spring will be stretched in the opposite direction via another connecting rod 18. When the rocker member 15 needs to return from the rocking position to the rest position, the compressed spring 6 on the rear side will provide a certain restoring force to assist in the returning of the rocker member 15.

Figure 6:
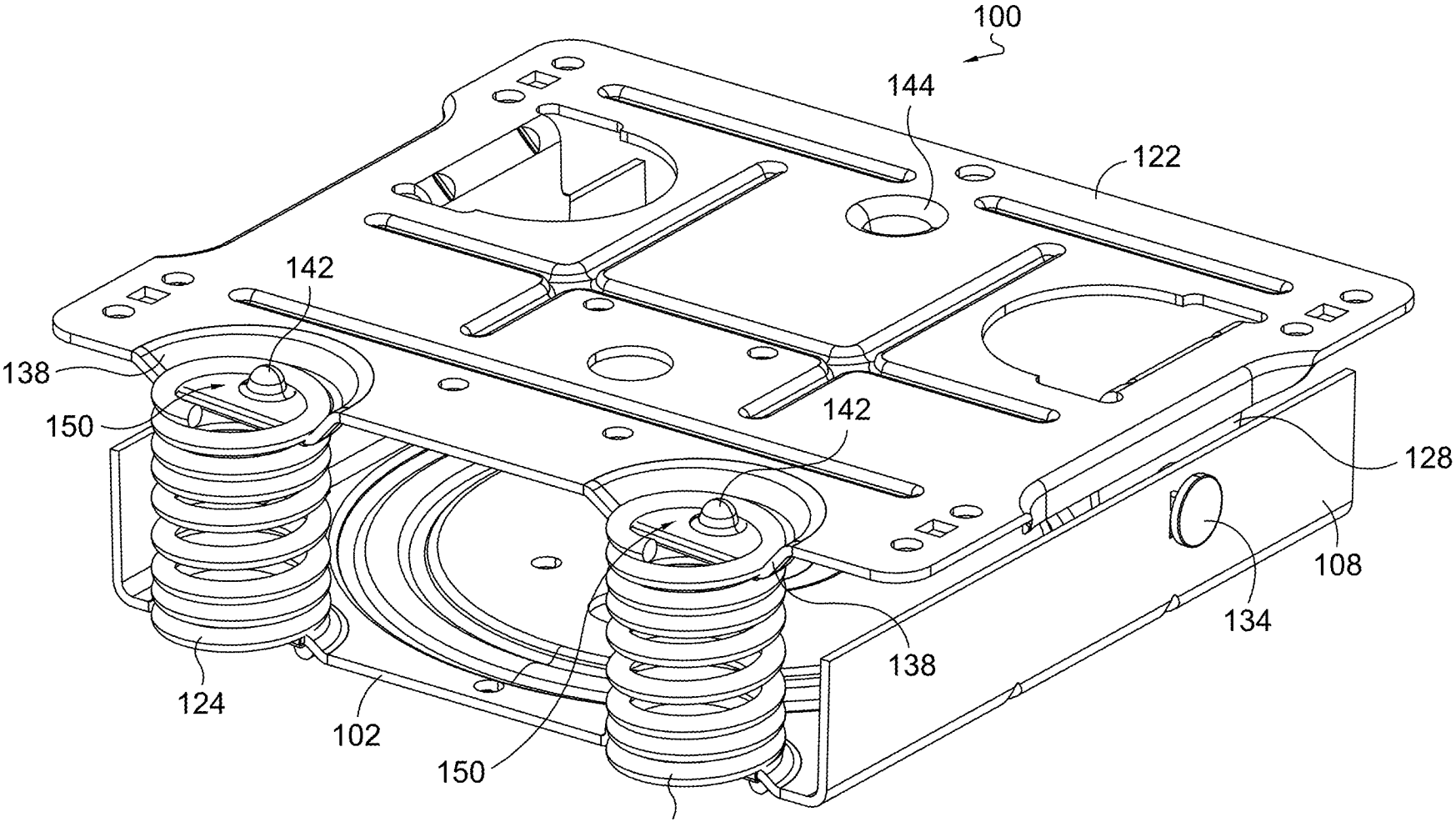
FIG. 6 is a perspective view of a rocker assembly for a rocking chair according to another aspect of this disclosure.
Figure 7:
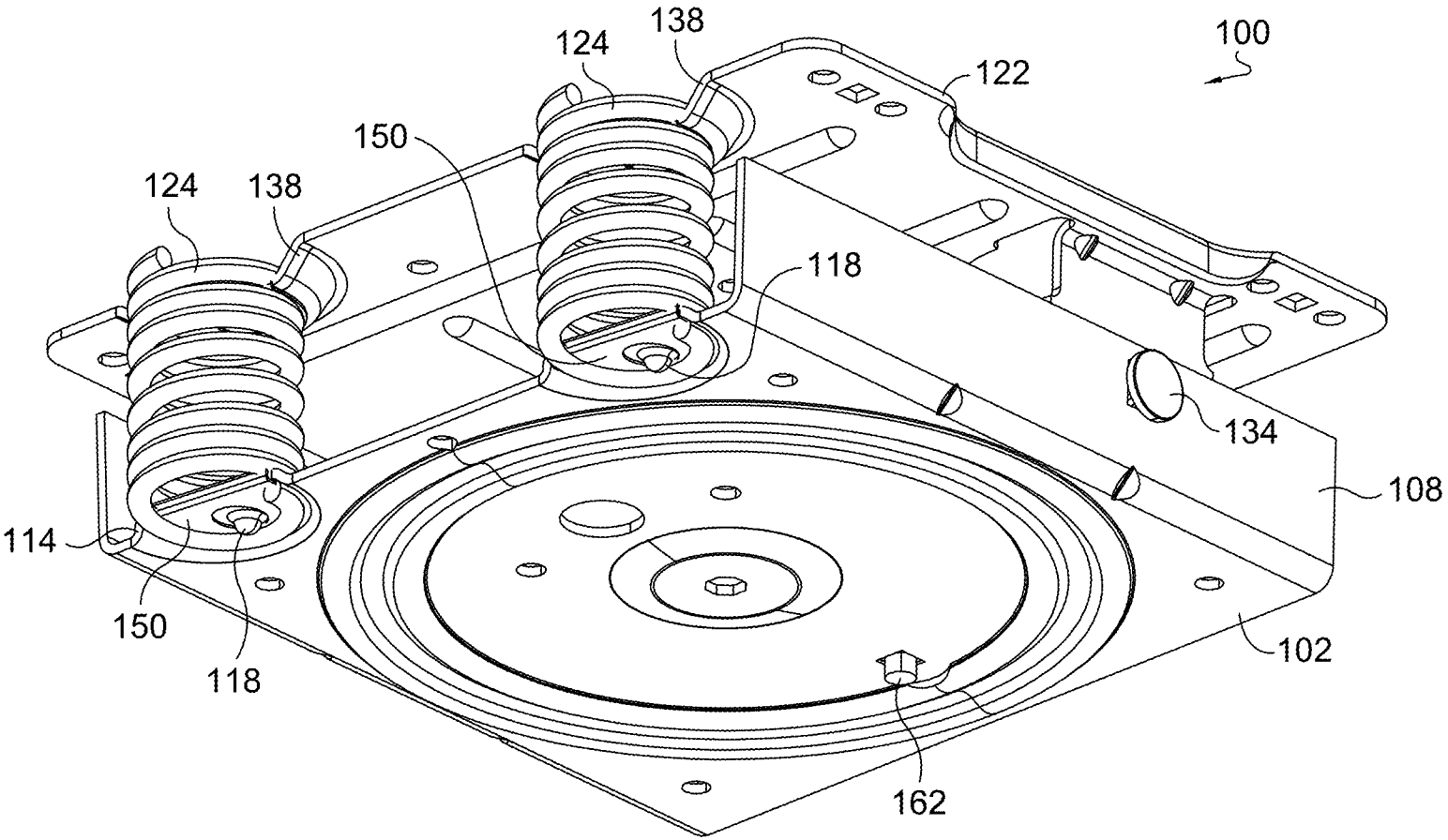
FIG. 7 is a view similar to FIG. 6, but from a different perspective.
Figure 8:
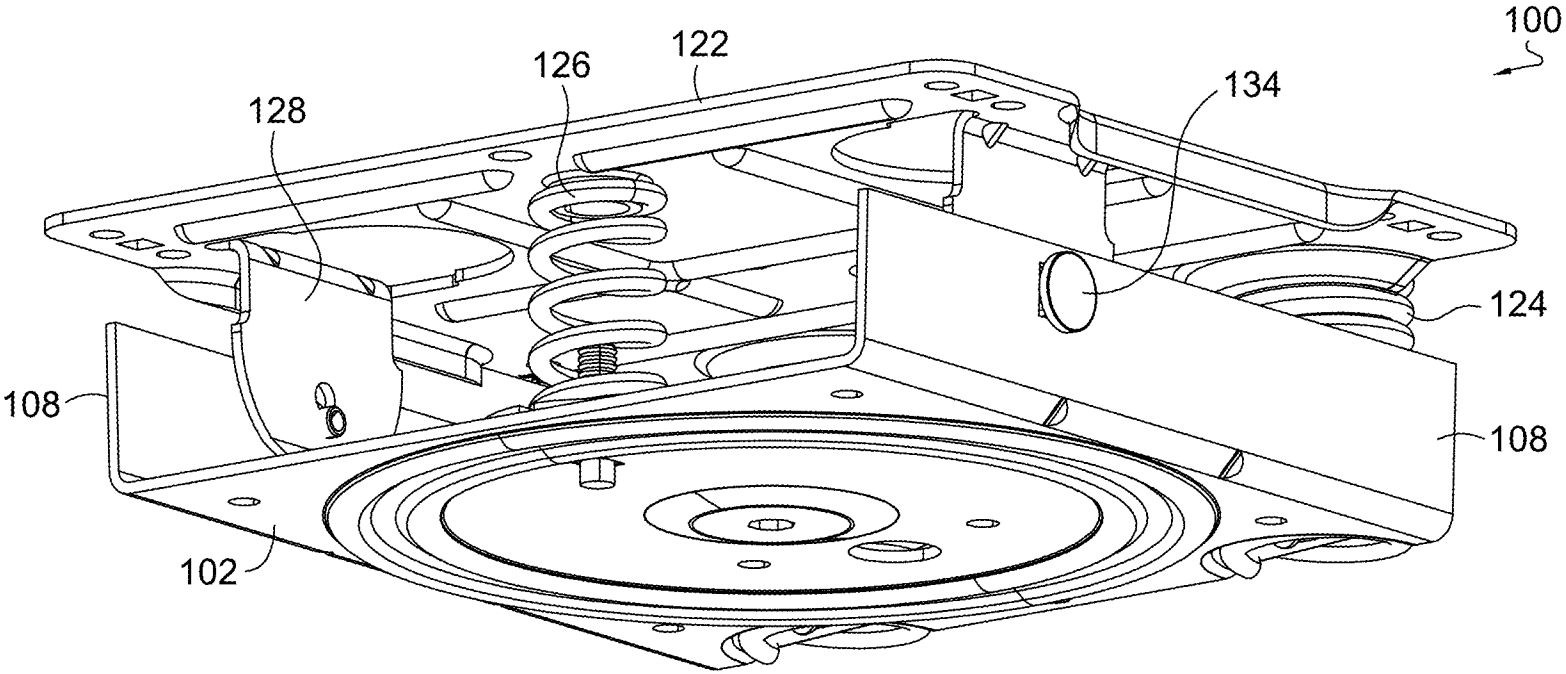
FIG. 8 is a view similar to FIG. 6, but from another different perspective
Figure 9:
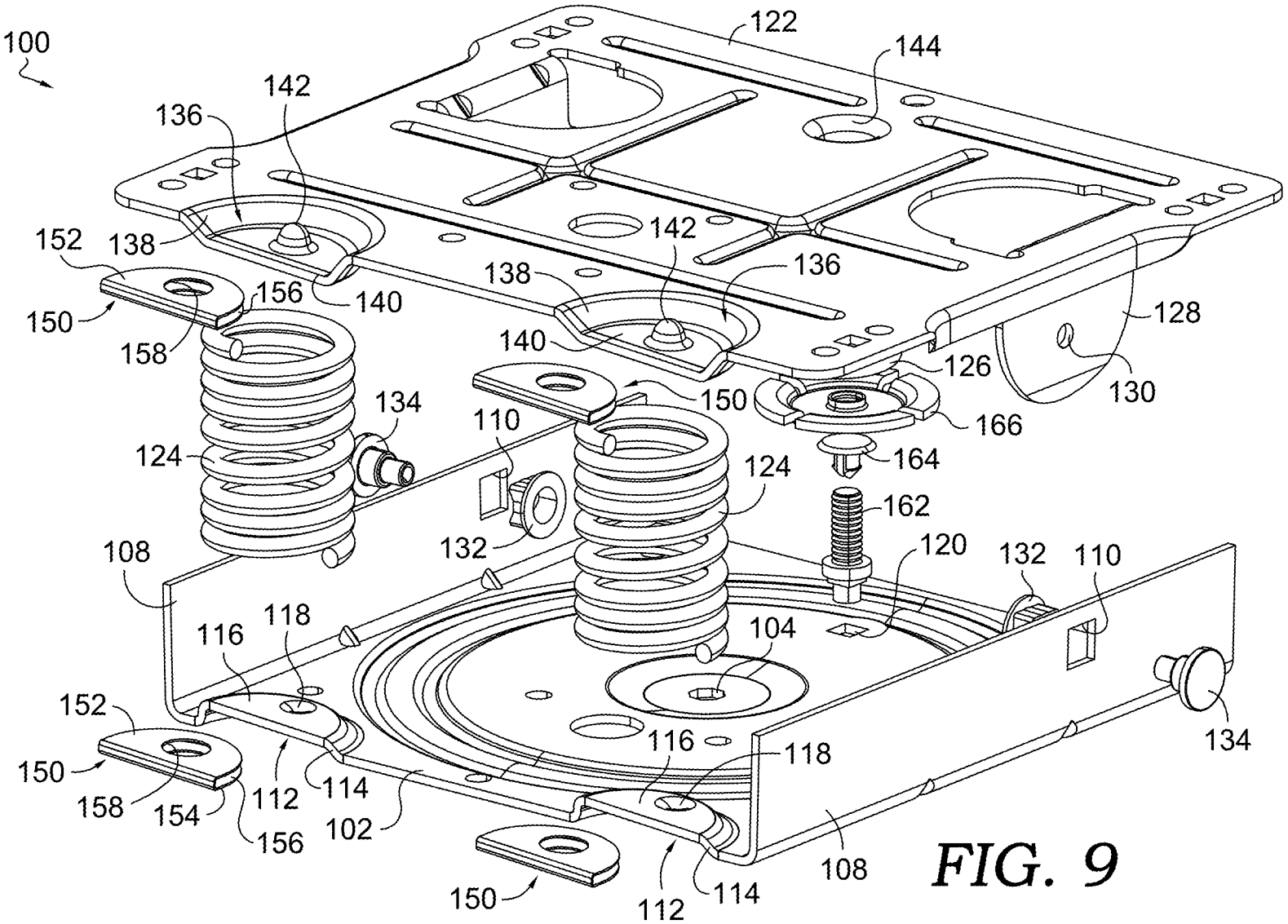
FIG. 9 is an exploded view of the parts of the rocker assembly of FIG. 6.
Figure 10:
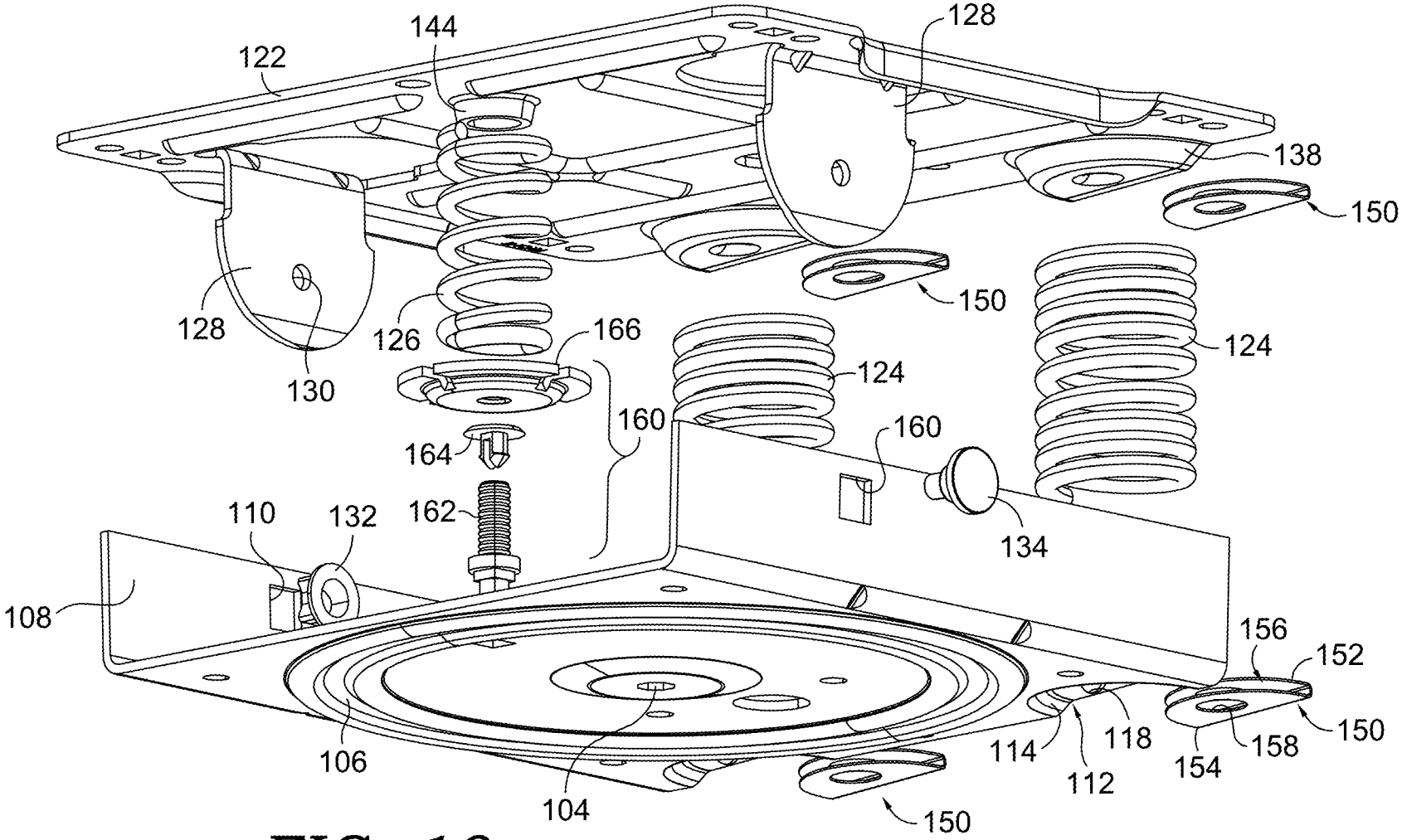
FIG. 10 is an exploded view of the parts of the rocker assembly of FIG. 8.

In another aspect, as seen in FIGS. 6-10, a rocker box 100 is shown. In some aspects, the rocker box 100 can be used on a rocking chair, and in other aspects, the rocker box 100 can be used on a rocker chair with a swivel as well. The rocker box 100 includes a base plate 102 that is coupled either to the chair base, or to a swivel structure, as would be known by those of skill in the art. The base plate 102 may include a central hole 104 for coupling the base plate 102 to a swivel structure. In this aspect, the central hole 104 defines the axis about which the rocker box 100 swivels. As best seen in FIG. 10, the bottom of the base plate 102 may include a circular recess 106 that can serve, in some aspects, as a recess for swivel bearings. The base plate 102 may also include upwardly extending sidewalls 108. As seen in FIG. 8, the sidewalls 108 may include a hole 110.

In some aspects, the front of the base plate 102 includes two partially circular indentations 112. The indentations 112 could be formed, for example, in a stamping process. The indentations 112 extend upwardly from the main portion of the base plate 102, and have a partially circular outer wall 114, terminating at a planar surface 116. As best seen in FIG. 7, a protuberance 118 extends downwardly from the planar surface 116, spaced slightly away from the wall 114. In some aspects, the protuberance 118 can be cylindrical or semi-spherical in shape. In some aspects, the protuberance 118 can be formed in a stamping process. As best seen in FIG. 9, the bottom plate 102 may also have a square hole 120 formed therein, generally centered on the bottom plate 102 between the indentations 112, and rearward of the hole 104 and slightly rearward of the holes 110.

A rocker plate 122 is spaced above the base plate 102, and is held in this spaced relationship by two front springs 124 and a rear spring 126 (see FIG. 10), as will be further described below. The rocker plate 122 is coupled, either directly or indirectly, to the seat of the chair on which the rocker box 100 is used. As best seen in FIG. 10, the rocker plate 122 may include downwardly extending mounting tabs 128 that may be integrally formed with the rocker plate 122. Each mounting tab 128 includes a hole 130. The rocker plate 122 may be pivotally coupled to the base plate 102. More specifically, in some aspects, a bushing 132 may be placed through a corresponding hole 110 in the sidewall 108. A rivet 134 may then be installed through the hole 130, coupling the rocker plate 122 to the base plate 102. In some aspects, the front of the rocker plate 122 includes two partially circular indentations 136 that are similar to, or the same as, the indentations 112. The indentations 136 could be formed, for example, in a stamping process. The indentations 136 extend downwardly from the main portion of the rocker plate 122, and have a partially circular outer wall 138, terminating at a planar surface 140. As best seen in FIG. 6, a protuberance 142 extends upwardly from the planar surface 140, spaced slightly away from the wall 138. In some aspects, the protuberance 142 can be cylindrical or semi-spherical in shape, and can be formed in a stamping process. The rocker plate 122 also includes a downwardly extending collar 144 that is cylindrical in shape.

As seen in FIGS. 6 and 9, the rocker box 100 also includes one or more spacers 150. In some aspects, as shown in FIG. 9, four spacers 150 are used (two for each spring 124). Each spacer 150 can be shaped to correspond to the indentations 112 and/or 136. So, in some aspects, the spacers 150 have a generally semi-circular shape. Each spacer 150 has a top portion 152 spaced from a bottom portion 154, leaving a gap 156 between the top portion 152 and the bottom portion 154. In some aspects, the spacer 150 may be integrally formed as a one-piece structure. Both the top portion 152 and the bottom portion 154 may have a hole 158 extending therethrough. Like the spacer 7 discussed above with reference to FIGS. 1-5, the spacer 150 may be formed of a plastic material. Other materials are also usable and are within the scope of this disclosure. In use, a spacer 150 is placed within a corresponding indentation 112 or 136, with the protuberance 118 and/or 142 extending through the hole 158. The corresponding planar surface 116 or 140 extends into the gap 156, such that the spacer covers both the top and bottom of the base plate 102 or the rocker plate 122. With the spacers 150 in place, the front springs 124 extend over the bottom portion 154 on the base plate 102, and over the top portion 152 on the rocker plate 122. More specifically, at least one turn of the springs 124 extends over the spacers 150, such that the spacer 150 is between the last turn of the spring 124 and the metal of the base plate 102 or the rocker plate 122. The springs 124 are held in place, at least partially, by the protuberances 118 and 142. The spacers 150 are also held in place, at least partially, by the protuberances 118 and 142. In addition, the spacers 150 are held in place by the springs 124. In this way, the spacers 150 make it possible to avoid direct contact between the springs 124 and the base plate 102 and the rocker plate 122, to reduce unwanted noise generated during the rocking process.

As best seen in FIGS. 8 and 9, a pitch adjustment assembly 160 is coupled to the base plate 102. More specifically, a threaded stud 162 is held in the hole 120 and extends upwardly from the base plate 102. A spring base 166 is threaded onto the stud 162 and may be further held in place with a retainer pin 164. The spring base 166 is shaped to accommodate the lower end of the rear spring 126. The rear spring 126 is not coupled to the spring base 166, but rests upon it. The upper end of the rear spring 126 is held in alignment via the collar 144, but the top of the rear spring 126 is not coupled to the rocker plate 122.

The front springs 124 operate to resist or cushion the forward and rearward rocking of the rocker plate 122 (and thus the seat of the chair) above the base plate 102, pivoting about an axis defined by holes 130. The front springs 124 thus operate to return the rocker plate 122 to a neutral position when a rocking force is not applied to the rocker plate 122 (such as by a user). The rear spring 126 operates to resist over-rocking in the rearward direction, but does not resist a forward rocking motion.

It can be seen that the rocker assembly and rocker box according to the present disclosure includes very few structural components, is very compact in structure, and can be adapted to various types of rocking chairs. In addition, the provided spacer(s) avoid direct contact between at least one turn of the spring and the mounting plate, which significantly reduces the noise while allowing a greater rocking angle.

It should be noted that the above embodiments are merely illustrative, and the present invention is not limited to these embodiments. Upon consideration of the present specification, those skilled in the art can make various changes and modifications without departing from the scope or spirit of the present invention. The true scope of the present invention is determined by the claims and their equivalents.

What is claimed:

1. A rocker box for use on a rocker chair, the rocker box comprising:

a base plate;

a rocker plate spaced from the base plate and pivotally coupled to the base plate;

at least a first spring extending between the base plate and the rocker plate, the first spring being coupled on one end to the base plate and on the other end to the rocker plate; and a first spacer extending between the first spring and the base plate, such that the first spring does not contact the surface of the base plate and a second spacer extending between the first spring and the rocker plate such that the first spring does not contact the surface of the rocker plate.

2. The rocker box according to claim 1, further comprising at least a second spring extending between the base plate and the rocker plate, the second spring being coupled on one end to the base plate and on the other end to the rocker plate; and a third spacer extending between the second spring and the base plate, such that the second spring does not contact the surface of the base plate and a fourth spacer extending between the second spring and the rocker plate such that the second spring does not contact the surface of the rocker plate.

3. The rocker box according to claim 2, wherein each of the first, second, third and fourth spacers has a top portion and a bottom portion spaced from the top portion, and wherein one of the base plate and the rocker plate occupy the space between the top portion and the bottom portion.

4. The rocker box according to claim 3, wherein each of the first, second, third and fourth spacers has a hole extending therethrough, and wherein the base plate and the rocker plate have a protuberance extending therefrom at the location of one of the first spring and the second spring, the protuberance extending through the hole in a respective spacer.

5. The rocker box according to claim 4, wherein a last turn of one of the first spring and the second spring is held in place by the protuberance.

6. The rocker box according to claim 5, wherein each of first, second, third and fourth spacers is symmetrical such that the top portion mirrors the bottom portion.

7. The rocker box according to claim 1, wherein the base plate comprises an indentation shaped to accommodate the first spring and the first spacer.

8. The rocker box according to claim 7, wherein the rocker plate comprises an indentation shaped to accommodate the first spring and the second spacer.

9. A rocker box for use on a rocker chair, the rocker box comprising:

a base plate;

a rocker plate spaced from the base plate and pivotally coupled to the base plate at a pivot axis;

a pair of springs extending between the base plate and the rocker plate, the springs being coupled on one end to the base plate and on the other end to the rocker plate; and a spacer extending between the springs and each of the base plate and the rocker plate, such that the first springs do not directly contact the surface of the base plate or the rocker plate.

10. The rocker box according to claim 9, wherein the spacers each have a top portion and a bottom portion spaced from the top portion, and wherein one of the base plate and the rocker plate occupy the space between the top portion and the bottom portion.

11. The rocker box according to claim 9, wherein each of the spacers has a hole extending therethrough, and wherein the base plate and the rocker plate have a protuberance extending therefrom at the location of each of the springs, the protuberance extending through the hole in a respective spacer.

12. The rocker box according to claim 11, wherein a last turn of the springs is held in place by one of the protuberances.

13. The rocker box according to claim 9, wherein the spacers are symmetrical such that the top portion mirrors the bottom portion.

14. The rocker box according to claim 11, wherein the base plate comprises an indentation shaped to accommodate the spring and the spacer.

15. The rocker box according to claim 14, wherein the rocker plate comprises an indentation shaped to accommodate the first spring and the second spacer.

* * * * *